US007100329B2

(12) United States Patent
Pleasants

(10) Patent No.: US 7,100,329 B2
(45) Date of Patent: Sep. 5, 2006

(54) UNIVERSAL ATTACHMENT ASSEMBLY FOR CLAMPING AND BRACING COVERS OVER OPENINGS

(76) Inventor: Frank Monroe Pleasants, 359 Poplar Dr., Dawsonville, GA (US) 30534

( * ) Notice: Subject to any disclaimer, the term of this patent is extended or adjusted under 35 U.S.C. 154(b) by 189 days.

(21) Appl. No.: 10/698,085

(22) Filed: Nov. 3, 2003

(65) Prior Publication Data

US 2005/0091923 A1 May 5, 2005

(51) Int. Cl.
*E05C 21/02* (2006.01)

(52) U.S. Cl. ..... 49/465; 52/202; 24/68 CD; 24/265 H; 24/680

(58) Field of Classification Search ..... 49/463, 49/465; 24/68 CD, 265 H, 68 D, 370; 52/202, 52/203

See application file for complete search history.

(56) References Cited

U.S. PATENT DOCUMENTS 2,598,610 A * 5/1952 Satz et al. ..... 49/463
2,676,374 A * 4/1954 Ballard ..... 24/360
2,856,663 A * 10/1958 Elsner ..... 24/182
3,762,119 A * 10/1973 Sowle ..... 52/202
4,406,320 A * 9/1983 Bingham ..... 160/370.21
4,691,477 A * 9/1987 Governale ..... 49/380
4,960,353 A * 10/1990 Thorndyke ..... 410/20
5,383,509 A 1/1995 Gaffney et al. ..... 160/209
5,503,211 A * 4/1996 Engi ..... 160/290.1
5,579,604 A 12/1996 Holung et al. ..... 49/61
5,620,038 A 4/1997 DeCola et al. ..... 160/209
5,894,705 A * 4/1999 Sutton ..... 52/747.1
6,161,605 A * 12/2000 Pena ..... 160/90
6,195,848 B1 * 3/2001 Jackson et al. ..... 24/68 CD
6,637,077 B1 * 10/2003 Doty ..... 24/302
2003/0134091 A1 7/2003 Wade

* cited by examiner

*Primary Examiner*—Jerry Redman
(74) *Attorney, Agent, or Firm*—Myers & Kaplan LLC; Sandra M. Drummond; Joel D. Myers

(57) ABSTRACT

A universal attachment assembly for installing, and bracing covers over openings. More particularly securing shutter panels over doors and windows in masonry construction without defacing the walls. Novelty, simplicity, economy, vibration resistance and speed of installation are characteristics of the assembly. Tensile force is created by commercially available ratcheting device 21 and transmitted by flexible, lightweight straps 22 within universal attachment assembly 20. Marginally distributed paired fulcrum holes 23 in shutter 24 provide bearing against the structural rigidity of shutters 24 to convert strap tension into compression by novel specialized structural clamping levers 10. Corner of wall opening 25 is clamped by lever against shutter 24. Elasticity of straps provides resilience in maintaining constant, high, compressive loading against concrete sills, etc. despite fluctuations due to turbulent wind loads. An additional embodiment is structural column assembly 30, which provides braces for garage doors or intermediate structure for wide architectural openings. All applications use identical, unaltered, universal attachment assemblies 20 for: shutter attachment, garage door bracing, and bracing of shutters in large architectural openings. Structural column, 31, herein shown as lumber and termination angle (not shown), provide shear connections of brace to structure.

10 Claims, 3 Drawing Sheets

UNIVERSAL ATTACHMENT ASSEMBLY FOR CLAMPING AND BRACING COVERS OVER OPENINGS

BACKGROUND-FIELD OF INVENTION

This invention relates to a mechanism for attaching covers over openings, anchoring intermediate supports between covers and securing braces behind weak covers and more particularly to the specialized clamping lever which enables these capabilities. Such attachment assemblies are commonly used to attach shutters over window and door openings and to anchor structural columns to brace garage doors and provide intermediate support for shutters during hurricanes.

BACKGROUND-DESCRIPTION OF PRIOR ART

The present invention relates specifically to the connection and installation of covers of all types over openings of all types without defacing the surface of the openings. Herein after, one of the most severe and dramatic applications will be used to represent all applications—that of the protection of one's home at the approach of a hurricane. Novelty, simplicity, economy, vibration resistance and speed of installation are characteristics of this invention.

The down sides and obvious cost and damage due to hurricanes is common knowledge. The reader is referred to most all patents on the subject for this background and it will not be repeated herein.

Concrete is known and well documented in history as an excellent material in compression. However, in structural uses concrete has zero allowable strength in tension. Only metallic inserts, which create diagonal compression in the creation of a shear cone about the fastener, are attributed to producing tensile attachment. To exacerbate this problem, concrete is friable and subject to crumbling when exposed to cyclical compressive and tensile loading as by the turbulent winds of a hurricane. And yet, most buildings constructed close to ocean shores are concrete.

How then does one generate a resiliently soft but strong compressive force and eliminate the tensile forces as is required by the inherent nature of concrete? And further, how does one transfer this to the violently, fluctuating turbulent loads as generated by hurricane winds? And all the while, economics, ease of handling and speed of installation over a wide diversity of sites and shapes of openings must be provided. This is precisely the teaching of this patent.

The predominant direction of technology and investment is currently to create better inserts for concrete. That is, to try to pack tremendous resiliency in the small clearances between the concrete and the insert. All the while, these devices are making bigger scars on the face of buildings. The approach is generally accompanied by permanent mounting tracks or rails around the openings to further distract from the appearance of the home. (Ref. US2003/0134091 AL etc.) Installations of these critical devices are prone to error as witnessed by the following recent example.

It is no accident that after the landfall of the second tropical storm of 2003 in the USA, in Texas, the greatest cost of damage was attributed to failed inserts into concrete. Vibration loosened the inserts and the winds ripped off shutters burst windows and flooded the buildings with heavy rains. And this was only a class 1 hurricane. Even if the insert stays in, a tremendous disadvantage with inserts is that threaded metal female inserts or threaded studs are left permanently mounted outdoors in saltspray, rain and dusty environments, or, worse, being covered with paint. Even stainless steel in this application is subject to galling and cross threading and galvanized steel is no better. None of these concerns are comforting when a hurricane in rapidly approaching.

The approach of mounting a compressive device inside the opening and using compression to secure it is presented by Holvng in U.S. Pat. No. 5,579,604. As further precedence the reader is referred to his section 3 of this patent—"Description of the Prior Art". His comments are referenced without exceptions.

The greatest problem, however, with all previous devices is that compressive members over large spans are subject to buckling or collapse due to bending. Therefore compressive members must be laterally braced and or increased in mass and cross section to prevent buckling. This results in more weight, complexity and therefore cost and failure potential. This, in turn increases the difficulty and time of installation.

One final problem, which can be overcome to the detriment of the teachings of U.S. Pat. No. 5,579,604, relates to the lack of detents or shallow holes in the sidewall of the building's openings. Concrete block construction is almost universally finished with stucco. Initial tests on the present invention revealed that most stuccoes crumble under compression and shears off the surface. This leaves sand and chips of debris, which act as a lubricant similar to gravel on a curve in a road. It is necessary to at least penetrate the finish layer and expose solid aggregate to rest the compressive member on. However, additionally, the addition of a slight ridge for the compressive foot to rise over assures that this will not be the weakest link in the design. The present invention relies on the rigidity of the shutter to carry the compressive force. The limiting requirement of a shutter is not its strength but the deflection required by codes. Therefore the specific requirements of each type of material, be it plywood or corrugated steel, plastic or aluminum vary and the allowable spans must be evaluated separately. In any event, the panel is already designed for stiffness and a small limitation of span or increase of metal gauge is the only consequence, depending on the class of hurricane and wind speed being assumed for the geographic area.

A final point regarding inserts and anchors. They require full penetration of the block's web and, in most cases, the introduction of leakage paths of water into the cores of the block. Indoor air quality and mold potential is only now beginning to be addressed. As required by the present invention, the small shallow dents are approximately ⅓ to ½ of the depth of the wall of the block. When painted like the wall and located on the side of the wall rather than the face of the wall it is virtually invisible with no concern of corrosion, thread damage, or contamination of interior air quality.

OBJECTS AND ADVANTAGES

The object of the present invention is first to generate a tensile latching force by an inexpensive commercially available ratcheting device. And further, this tensile force is transmitted the width of the cover or the length of a structural column by inexpensive, light weight straps. This device is located between the fulcrum points of the panel. Therefore the material required to transfer these forces are only a very light, flexible, and inexpensive strap. Only then are the rigid and strong levers necessary to operate in cooperation with the cover to result in compression against the structure of the opening. The mounting of the assembly is accomplished by simply drilling holes at the margin of the panel, and inserting the levers to convert tensile forces outboard of the shutter to compressive forces bearing on the concrete inboard of shutter.

The geometry of the various load points of the lever and the location of the fulcrum generate an acute angle of the force vector relative to the panel. This clamps a portion of concrete between the lever and the shutters and snuggs the shutter against the outside face of the opening. On thin metal or plastic panels, a grommet is applied to the hole to relieve stress concentrations and deformation of the materials by uniformly distributing the point load over a larger area of the panel.

A further object of the invention is to use the inherent elasticity of the straps to provide constant compression of the levers against the concrete regardless of the turbulent buffeting of the winds. By initially preloading the straps in tension, a large compression force is superimposed over the cyclical loads. Therefore the resultant load is a varying compressive load. This totally eliminates the need for the unattractive inserts and their frequent failure. This concept is well proven by the use of this type of apparatus in cargo clamps on exposed trucks or trailers.

The present invention also is used, without modification to a closely related application of the ratcheting strap type tensioning system. This additional device is a structural column to be used as an intermediate support for spanning of long architectural openings by the shutters. A second object of these columns is the bracing of garage doors. This application consists of structural 2" thick lumber, a plurality of clamp assemblies and metallic termination angles. This angle provides a narrow fulcrum point for the lever. It also converts what would be an instable bending connection into a stable and strong shear connection.

This design provides the same advantages as described in the shutter. The troublesome inserts are eliminated as they are shown in U.S. Pat. Nos. 5,383,509, and 5,620,038 among others.

BRIEF DESCRIPTION OF DRAWINGS

FIG. 1 is a detail of the specialized structural clamping lever.

FIG. 2 is a side view of universal attachment assembly.

FIG. 3 is a cross-sectional view showing shutters, opening, a structural column assembly and a plurality of universal attachment assemblies.

FIG. 4 is a perspective view of structural column assembly 30.

FIG. 5 is a side view as shown by cut in FIG. 4 of termination angles of structural column assembly 30.

FIG. 6 is a section view of grommets used in thin corrugated shutters of steel, aluminum or plastic.

DETAILED DESCRIPTION OF PREFERRED EMBODIMENT

Referring to FIGS. 1 through 6, the terminology utilized for representing generic fasteners for securing covers over openings is that of the typical application of storm shutters over windows and doors of buildings. While this provides visibility and familiarity of the configuration it is not intended to limit applicability of the present invention. Fabrication of all elements is intended to be substantially of commercially available practice now or as in the future and is not limited to the current materials or practices shown.

Figure 1:
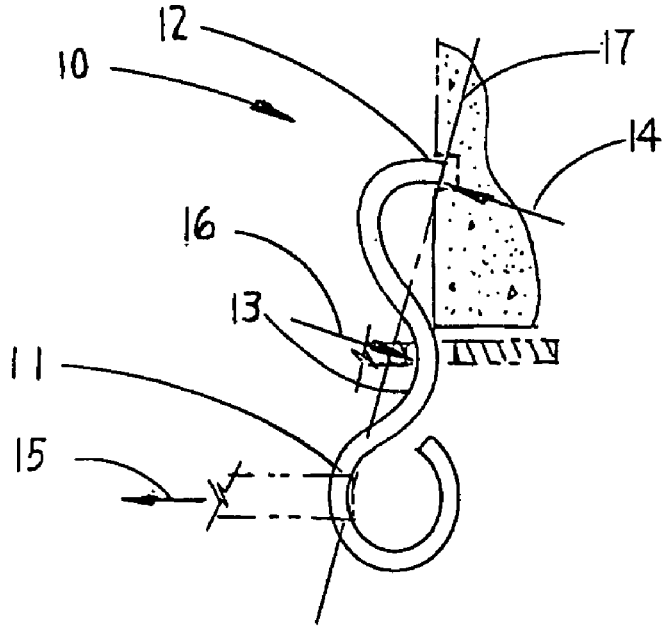
FIG. 1 to 6

FIG. 1 is a detail of the specialized structural clamping lever. In FIG. 1 item 10 is the specialized structural-clamping lever used to enable the capabilities of all following embodiments and assemblies. Item 11 is the specified first end for attaching to an adjustable length tensioning assembly herein shown as a strap item 22*a* and 22*b*. Concavity 13 of the said lever is saddled onto the edge of the fulcrum hole 23. Item 12 is the specified second end which is first passed through said fulcrum hole 23 and finally brought to bear on the bottom and sidewall of retainer holes 26 bored into interior face of window sills, door jams, etc.

It will be noted that for stability to exist in the loaded lever, the load point of the fulcrum holes 23 must be located to the right of a line of centers through the load points 17 of the two ends as the lever is shown in FIG. 1. In this disclosure, the lever is made of a bent and hardened steel rod, which is the present practice of almost all manufacturers of commercially available ratcheting device 21. However, stamped, cast forged, etc. levers of any suitable material can be substituted and still comply with the function and intent of the lever. This will change the appearance but not the function. Any other guides, moment connections etc. used to prevent rotation of the loaded lever would satisfy the intent of the preferred embodiment.

Figure 2:
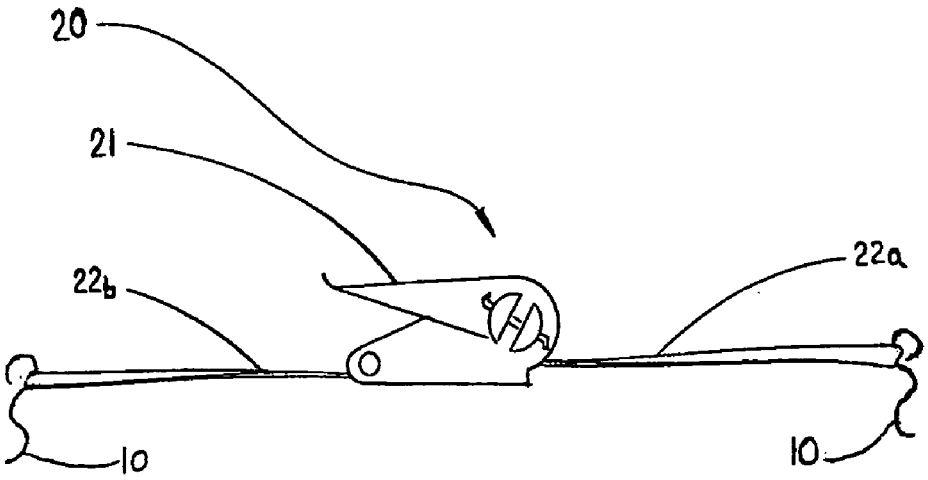

FIG. 2 is a side view of universal attachment assembly. In FIG. 2, item 20 is the universal attachment assembly. Commercially available ratcheting device 21 for adjusting the length of the assembly while generating a controlled and reliable tensile force is shown rotated 90 degrees relative to said levers for clarity. A comparable assembly with hooks on the end rather than levers are the "Ratcheting tie-downs by "Workforce" which is the store brand of Home Depot, 2455 Paces Ferry Road, Atlanta, Ga. 30339. Designated first strap 22*a* of item 20 connects at its first end to a first said item 10 lever. The second end of said 22*a* strap is free to be wrapped about the drum of said item 21. Designated second strap 22*b* is securedly attached at its first end to a second said item 10 lever and at its second end to the body of ratcheting device 21.

Figure 3:
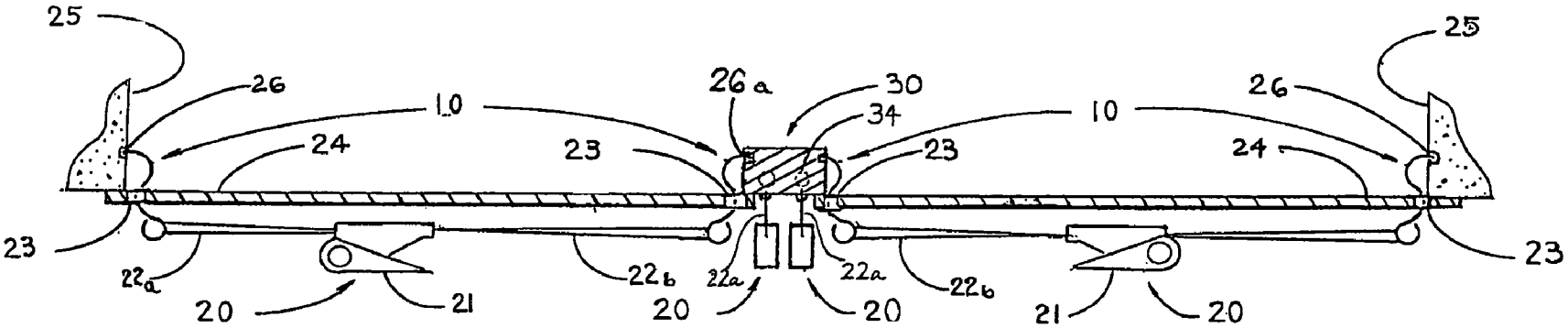

FIG. 3 is a plan section view showing shutters, opening, a structural column assembly and a plurality of universal attachment assemblies. In FIG. 3 items 23 are paired fulcrum holes drilled in the margin of item 24 shutter. Shutter 24 can be almost any manually installed shutter panel. Interior wall faces 25 are such items as windowsills, doorjambs etc. Item 26 is a retainer hole for end 13 of the respective lever 10.

Figure 4:
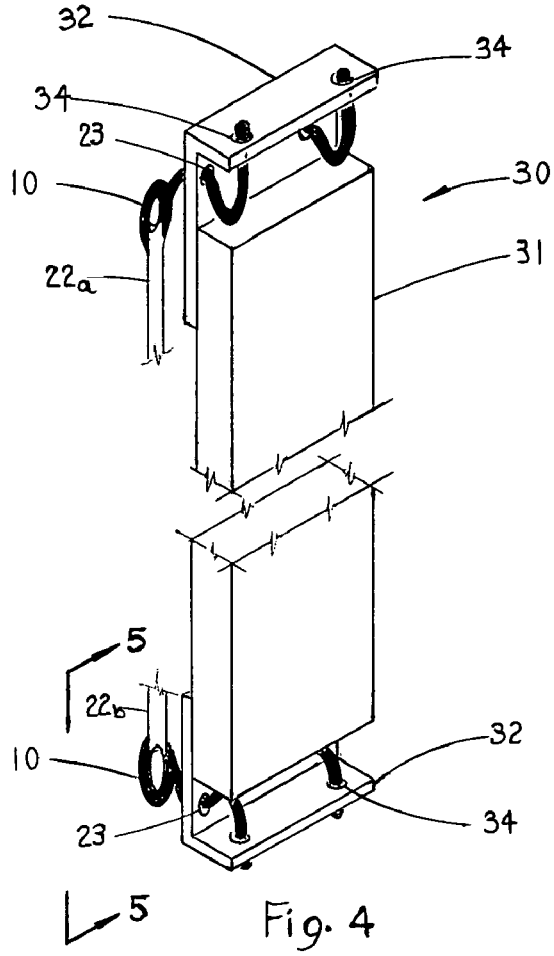
Figure 5:
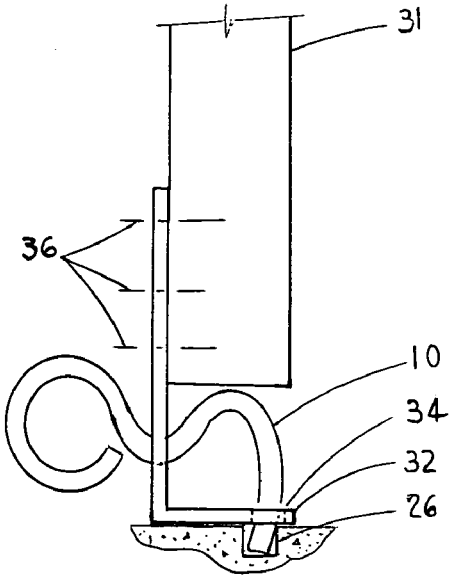

FIG. 4 is a perspective view of structural column assembly 30. FIG. 5 is a section through termination angle 32 of structural column assembly 30. Within FIG. 4 and FIG. 5, structural column assembly 30 provides strength and rigidity for bracing garage doors or as shown in FIG. 3 it provides an intermediate support for shutters in architectural openings too wide to be economically spanned by a single shutter. Structural column 31 is the compression and bending providing element of this embodiment. Structural column 31 is made of structural metal, lumber, plastic, composites, etc. Termination angle 32 is attached to lumber structural column primarily to provide a narrow cross section at fulcrum hole 33 for concavity 12 to bear against. For metal, composites, etc, the thickness of the element may or may not require termination angle 32. Alignment holes 34 provide guides and shear connection to the garage floor and roof structure. It will be noted that supplemental structures may be necessary to attach to garage ceilings, depending on site-specific conditions. Alignment holes 24 provide guidance and retention of lever motion. Attachment 36 means are typical fasteners such as screws or bolts. The length of the column assembly should be adjusted for a slip fit or preferably a light force fit between faces of the openings in which they are installed to provide a sheer connection. A pair of slotted holes for attachment means 36 facilitate this adjustment.

Figure 6:
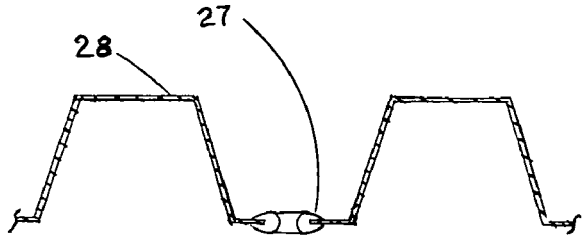

FIG. 6 is a section view of grommets used in thin corrugated shutters of steel, aluminum or plastic. Within FIG. 6 grommet 27 is used to stiffen the thin metal and distribute the load over a sufficient length to accept the fulcrum load.

I claim:

1. A removable assembly for covering an opening comprising:

a compression withstanding, structural, cover plate having peripheral dimensions slightly larger than the opening to be covered, said cover plate comprising a plurality of marginally located fulcrum holes paired in longitudinal opposition to one another;

a plurality of ratcheting attachment assemblies, each said ratcheting attachment assembly comprising a pair of clamping levers having a first end for fixedly attaching to a tension transmitting means, a second end for engagement with a structural member and an arcuate midsection defined therebetween, wherein said first end, said second end, and said arcuate midsection define a curved shape visible from a first two opposing directions, and wherein said first end, said second end, and said arcuate midsection define a straight shape visible from a second two opposing directions, said second two opposing directions perpendicular to said first two opposing directions, said arcuate midsection for bearing against a fulcrum opening in a respective cover member; a ratcheting device comprising a body, said body carried between said pair of clamping levers; a first said tension transmitting means terminated at a first end by fixedly connecting to said clamping lever, and a second, free end for adjustably wrapping around a drum of said ratcheting device; a second said tension transmitting means terminated at a first end by a second said clamping lever, and terminated at a second end by fixedly attaching to the said body of said ratcheting device; whereby each said clamping lever can be rotatably engaged respectively to a first and second fulcrum point on said cover member to provide fine adjustment of length and the development of compressive force against respective said structural members, with each said pair of said clamping levers inserted respectively through said paired fulcrum holes, whereby said holes are positioned as required for said clamping levers to generate paired moment couples about the hole as a fulcrum point for said second end of said clamping levers to provide a clamping action to an interior edge of said opening by clamping said clamping levers between said structural cover plate and-said interior edge.

2. The removably assembly for covering an opening of claim 1, further comprising a plurality of grommets carried proximate said plurality of fulcrum holes located in said cover plate.

3. A structural brace comprising:

an elongated structural support member;

a plurality of ratcheting attachment assemblies, each said ratcheting attachment assembly comprising a pair of clamping levers having a first end for fixedly attaching to a tension transmitting means, a second end for engagement with a structural member and an arcuate midsection defined therebetween, wherein said first end, said second end, and said arcuate midsection define a curved shape visible from a first two opposing directions, and wherein said first end, said second end, and said arcuate midsection define a straight shape visible from a second two opposing directions, said second two opposing directions perpendicular to said first two opposing directions, said arcuate midsection for bearing against a fulcrum opening in a respective cover member; a ratcheting device comprising a body, said body carried between said pair of clamping levers; a first said tension transmitting means terminated at a first end by fixedly connecting to said clamping lever, and a second, free end for adjustably wrapping around a drum of said ratcheting device; a second said tension transmitting means terminated at a first end by a second said clamping lever, and terminated at a second end by fixedly attaching to the said body of said ratcheting device; whereby each said clamping lever can be rotatably engaged respectively to a first and second fulcrum point on said cover member to provide fine adjustment of length and the development of compressive force against respective said structural members;

two L-profile angle adapters attached to ends of said elongated structural support member, wherein each said angle adapter has matching paired holes to provide fulcrum points to said clamping levers and to act as corresponding guide holes for said second ends of respective clamping levers, and wherein a paired plurality of opposing holes are defined in top and bottom inside faces of each said angle adapter, in matched spacing with said guide holes, whereby tension applied by said ratcheting attachment assemblies to said clamping levers is converted by fulcrums to compression, driving and holding said second ends of said clamping levers through said corresponding guide holes in a base leg of said angle adapter into a hole in an inside wall of an opening.

4. A lever system and panel for securing said panel over an opening, comprising:

a pair of levers, each said lever comprising a resistance end, an effort end, and a centralized fulcrum, wherein said resistance end and said centralized fulcrum define arcuately opposing paths, and wherein said effort end and said centralized fulcrum define arcuately opposing paths;

a tensile force transmitter carried by said pair of levers, extending from said effort ends thereof; and a tensile force generator carried by said tensile force transmitter, and adapted to deliver force thereto;

wherein said resistance end of each said lever is passed through an aperture defined in said panel to be secured, such that said centralized fulcrum of said lever is able to perform as an axis of motion proximate said aperture, and wherein said resistance end of each said lever is dimensioned to be received by an aperture defined in a peripheral interior edge of the opening to be covered by said panel to be secured.

5. The lever system of claim 4, wherein said tensile force transmitter is at least one strap member.

6. The lever system of claim 5, wherein said at least one strap member is elastic.

7. The lever system of claim 4, wherein said tensile force transmitter is removable from said levers.

8. The lever system of claim 4, further comprising a linking member carried between said levers and said tensile force transmitter.

9. The lever system of claim 4, wherein said effort end of each said lever defines an essentially sealed circle.

10. The lever system of claim 4, wherein said tensile force generator is adapted to enable incrementally selectable force.

* * * * *